United States Patent [19]

Giros

[11] 4,026,724

[45] May 31, 1977

[54] METHOD FOR TREATMENT OF ELONGATED FLEXIBLE MATERIAL

[76] Inventor: Marcel A. P. Giros, Route de Saint-Dizier, Ancerville, France, 55170

[22] Filed: Mar. 12, 1976

[21] Appl. No.: 666,199

Related U.S. Application Data

[63] Continuation-in-part of Ser. No. 361,616, May 18, 1973, Pat. No. 3,951,322, and a continuation-in-part of Ser. No. 666,198, March 12, 1976.

[52] U.S. Cl. ..... 134/14; 134/15; 134/18; 134/32; 226/4

[51] Int. Cl.[2] ..... B08B 1/00; B08B 1/02

[58] Field of Search ..... 134/14, 15, 18, 32, 134/64 R, 122 R; 226/4, 42, 43, 108, 117, 118, 119

[56] References Cited

UNITED STATES PATENTS

| | | | |
|---|---|---|---|
| 3,348,394 | 10/1967 | Giros | 134/14 |
| 3,501,347 | 3/1970 | Kenmore | 134/15 |
| 3,615,818 | 10/1971 | Ruthner et al. | 134/14 |

*Primary Examiner*—Robert L. Lindsay, Jr.
*Assistant Examiner*—George C. Yeung
*Attorney, Agent, or Firm*—Otto John Munz

[57] ABSTRACT

A method for treating elongated flexible material such as metallic strips, wire and tubes in a processing container holding a treatment fluid for treatment of the material chemically, electrolytically, by pickling, deposition and similar processes, provides for the steps of: coiling the material; imparting the coiled material the shape of a helix having a plurality of loops; causing at least a partial immersion of the loops of the helix in the treatment fluid; advancing the helix in the said container at an advance speed; controlling the entry speeds of the helix relative to a predetermined speed withdrawal of the helix from the container.

In a preferred and more efficient mode of treatment, the inlet speed of the helix exceeds the exit speed with a consequent slow and progressive increase of the length of the helix immersed in the treatment fluid at a time in a first phase of the operation.

In an additional improvement of the process in a second phase the inlet speed of the helix is temporarily lowered for restoring the initial length of the helix. Optimum speed limits are identified.

The progress of the loops within the container is subjected to momentary stops to control also the size of the loops. The helix is imparted forward and backward directed wave patterns of controllable amplitudes, durations and directions, resulting in optimum desirable treatment fluid exposures.

8 Claims, 21 Drawing Figures

3
70
5
6
ΔL
73
74
72

S2
S1

Sn

S3

Sp

S4

9' t

METHOD FOR TREATMENT OF ELONGATED FLEXIBLE MATERIAL COMPRISING THE STEPS OF:

Fig. 7

A. COILING THE ELONGATED MATERIAL INTO LOOPS

B. IMPARTING TO THE MATERIAL THE SHAPE OF A HELIX

C. INTRODUCING THE HELIX INTO THE CONTAINER AT AN INITIAL INLET SPEED UNDER A POSITIVE IMPELLING FORCE

D. CAUSING AT LEAST A PARTIAL IMMERSION OF THE LOOPS OF THE HELIX IN TREATMENT FLUIDS IN THE CONTAINER

E. ADVANCING THE HELIX THROUGH THE CONTAINER AT A PREDETERMINED ADVANCE SPEED

F. CORRELATING THE INLET SPEED WITH THE ADVANCE SPEED AT A PREDETERMINED RATIO

G. CAUSING INTERMEDIATE MOMENTARY INTERRUPTIONS IN THE ADVANCEMENT OF LOOPS RESULTING IN CONTROLLABLE FORWARD AND BACKWARD WAVE PATTERNS OF THE ADVANCING HELIX OF PREDETERMINED DURATIONS AND AMPLITUDES, FREQUENCIES AND DIRECTIONS OF THE LOOPS

H. CORRELATING THE ADVANCE SPEED WITH THE EXIT SPEED AT A PREDETERMINED RATIO

I. EXTRACTING THE LOOPS OF THE HELIX FROM THE CONTAINER AT A PREDETERMINED EXIT SPEED

J. REMOVING AND CORRELATING THE REMOVAL OF ADHERING FLUID FROM THE LOOPS EMERGING FROM THE CONTAINER WITH THE EXIT SPEED OF THE LOOPS

K. RINSING AND CORRELATING THE RINSING WITH THE EXIT SPEED OF THE LOOPS

L. PROVIDING METERING MEANS FOR THE TREATED MATERIAL AND TREATMENT-FLUID LEVEL MONITORING MEANS

M. PROVIDING MEANS FOR REPLENISHING USED-UP TREATMENT-FLUID IN CORRELATION WITH THE RESULTS ESTABLISHED BY MEANS L.

METHOD FOR TREATMENT OF ELONGATED FLEXIBLE MATERIAL

CROSSREFERENCE TO RELATED APPLICATIONS

This is a continuation-in-part application of a co-pending parent patent application Ser. No. 361,616 filed on May 18, 1973 now U.S. Pat No. 3,951,322 by the same inventor, for : METHOD AND APPARATUS FOR TREATMENT OF FLEXIBLE MATERIAL.

This application also is a continuation-in-part of a simultaneously filed application of the same inventor Ser. No. 666,198 for : APPARATUS FOR CONTINUOUS TREATMENT OF ELONGATED FLEXIBLE MATERIALS.

BACKGROUND OF THE INVENTION

1. Field of the Invention

Method for treating a coiled strand. (Class 134/14).

2. Description of the Prior Art

The prior art methods of treatment of flexible material, such as of a metallic band, tube or wire suffer the disadvantages that they cause changes in the frictional relationships of the material with the treating apparatus as the material advances at a given speed through a treatment container from ingress to outgress. These changes result in assymmetrical developments of loops in their spacings, and sizes and as in their disfigurations, bends and three-dimensional deformations, as well as in variable treatment times for individual loops, all this resulting in non-uniform and undesirable outputs.

SUMMARY OF THE INVENTION

The primary objects of the invention are to provide a method for surface treatments such as pickling, of elongated flexible materials, such as metallic bands, tubes, wires and strip metal traveling through a container holding a treatment fluid, which method:

- avoids the disadvantages of treatments used by the prior art;
- results in a uniform synchronized processing even of very lengthy materials having lengths up to several miles;
- decreases wear and tear on the treating apparatus, and
- permits an uninterrupted well organized continuous progress of the material through the container.

Another object of the invention is to control the ingress and advance speed of the material into and through the container in a first phase of the operation relative to the progress and exit speeds of the treated material.

Yet another object of the invention is to regulate the respective ingress, progress and egress speeds of the material relative to each other in such a manner that in the first phase of the operation the length of the material under treatment is increased while in a second phase of the operation, the length of the material under treatment is decreased, the optimum limits of which also have been established.

Other objects of the invention and the many of its advantages will become obvious to those skilled in the art from the following description taken in conjunction with the appended drawings and claims.

BRIEF DESCRIPTION OF THE DRAWINGS

FIG. 7 is a schematic diagram of the method steps of the invention.

DESCRIPTION OF THE PREFERRED EMBODIMENTS

Figure 1:
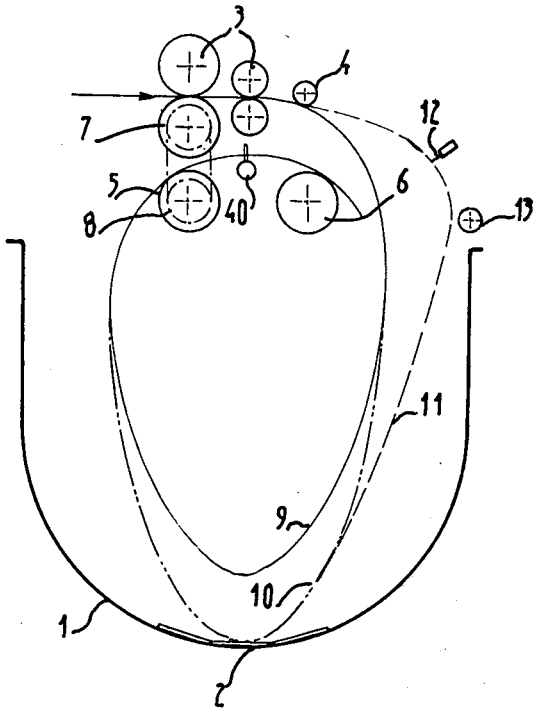
FIG. 1 is a schematic diagram, in perspective, of the processing container and motor means in accordance with the invention, for the treatment of material in strip form.

The method of the present invention is applicable to the apparatus shown in the parent case as well as to improvements depicted on FIGS. 1 to 7*a* and 8 to 12 of the present case. The apparatuses are shown by way of examples only and the invention is not limited to them.

The method of the parent case is explained on FIGS. 8 – 12 by example, in connection with an apparatus having a container for the treating fluid, first and second strip supporting elongated shafts journaled for rotation over the container in spaced side-by-side relation on two parallel axes, with a comb fixed between the shafts and in parallel with them in a plane substantially defined by their uppermost parts and co-extensive therewith. The comb comprises spaced upstanding teeth and rotating means engage and feed the material under a forwarding force at a predetermined speed first into the inlet side of the container at one end of the shafts, therefrom upwardly over and in transverse contact with the shafts in a plurality of loops, while each loop is guided between consecutive pairs of teeth of the comb, with each loop depending into the container for contact with the treating fluid. Steps are provided to control the relation between the angular rates of the co-joint rotation of the shafts and to positively feed and subsequently to extract the material from the container at predetermined speeds to provide loops of different sizes and with varying behaviors during the ingress into progress through and egress out of the container. The loops together form a helix, which advances continuously through the container and dips into the treating fluid therein.

Steps are provided to control the ratio of the linear speed of the helix inside the container (that is the progress speed) relative to its inlet and to its discharge speeds.

Additional steps are disclosed in the parent case to momentarily stop the advancing material, to control the size of the loops.

For purposes of brevity the subject matter of the above referenced parent case, now U.S. Pat. No. 3,951,322 issued Apr. 20, 1976 is to be included by reference.

The invention as depicted on FIGS. 1 to 7 of the present application discloses additional improvements over the parent case by providing in the method two stages to control the speed ratios in the respective ingress, progress and egress speeds of the processed material relative to each other:

a normal operating stage which synchronizes the progress speed with the egress speed, during which the length of the material in the container increases and an adjustment or normalizing stage during which the length of the material in the container decreases.

This is accomplished by providing intermittent "transient" contacts between the material and the walls of the processing container, to ensure a more satisfactory regulation of the production and behavior of the loops, resulting from the alternation of a normal rate of speed operation, accompanied by a slow increase in the length of the material being treated, with an adjustment period of shorter duration serving for the periodical reabsorption of the excess length accumulated during the period of normal operation.

Under a normal rate of operation the peripheral speed of the carrier shafts is slightly above that of the material on entering the apparatus, this latter speed itself being slightly above that of the material emerging from the apparatus.

The additional improvement disclosed in the present application provides steps and operational details aimed at the use of the transient contacts between the material to be treated and the walls of the processing container in an improved manner, in order to affect completely automatic regulation of the process, including the starting and stopping operations.

This regulation is effected by the alternation of normal running conditions with adjustment or normalizing conditions. During normal running conditions there is a succession of steps of three decreasing linear speeds, i.e. in the following order: the peripheral speed of the carrier shafts, the instantaneous speed of the material at the inlet and the speed of the material at the outlet; while these conditions of operation prevail, the total length of the material in the container slowly increases. While adjustment conditions prevail, their duration being shorter than the foregoing, the speed at the inlet becomes less than that at the outlet, to provide the readjustment required for the length of the material processed.

The method steps cause the material to enter the container at a speed which is:

- either slightly above the extraction speed under normal running conditions;
- or clearly below the extraction speed, (down to zero) during the adjustment phase;
- in the third place, a switch-over speed to control the independent motor means in accordance with the size of the first loop of the helix:
- when the first loop becomes larger than a certain reference size an adjustment step is provided to change from normal conditions to adjustment conditions;
- when the loop becomes smaller than this same reference size a normalizing step is provided to change from the adjustment conditions to the normal operating phase.

While the instantaneous values of the ingrees speed, the progress speed and the egress speed are never the same, neither in the normal running conditions nor in the normalizing conditions, it should be clearly understood that during a long period of operation, such as a full day, the mean ingress speed, the mean progress speed and the mean egress speed are equalized. These equalizations are obtained, according to the invention, through the phase alternations as described.

In accordance with another step of the invention the regulating action is made particularly efficient by providing a transient stop by contacts with the lateral wall of the container, in front of which the material passes from the top downwards ("downstream" wall) and avoiding such a contact with the base of the tank.

In the parent case a container was described having a circular cylinder base. In accordance with an improvement thereon the shape similar to a reversed pointed arch is being provided in order that any contact between the material and the lowest point in the base of the tank becomes impossible.

The angle of the pointed arch is narrower in proportion to the increase in the radial deformation capacity of the loops in accordance with the flexibility of their material.

The walls are lined with anti-corrosive bricks, if the treatment fluid is acid. On the wall where the transient contacts take place the lining is supplemented by a material such as slabs of volcanic lava. An improvement thereof is the step of providing polished electroceramic tiles, the inventor having discovered that their adhesion to the material being processed is firmer than that of the lining of the shafts, itself generally consisting of polyvinyl resin, as otherwise the transient contact would merely cause protracted friction, without bringing the loop to a stop.

Under these conditions, an automatic regulating cycle is obtained, as follows:

at the beginning of the normal operating phase of each cycle, the loops have the same size since they have been regulated at the end of the normalizing phase of the preceding cycle. The length of the material between the inlet and the outlet is at a minimum, but sufficient to ensure that the container will be filled in the normal manner. The driving speed of the shafts exceeds the inlet speed, so that the speed of the shafts goes beyond that required for the compensation of the inevitable slip normally taking place in the material being driven. Consequently, the loops on the outlet side tend to increase, at the expense of those on the inlet side. This increase in size, however, is uncertain, the coil becoming irregular. A larger loop than the next loop adjacent to it will make contact with the downstream wall. This results in a transient contact which sets up a reverse wave, progressing towards the inlet which regulates the loops through which it passes but which is generally only limited in time and does not reach the inlet. As a number of these limited temporary "retrograde" waves may occur simultaneously, the helix presents an appearance of permanent agitation resulting from being subjected to two conflicting forces:

the thrust of the material towards the outlet, the speed of the shafts being above the inlet speed, and the "retrograde" regulating waves triggered by each transient contact.

During this time, the length of the material in the container increases slowly but evenly, the inlet speed being slightly above the outlet speed. At the beginning of the normal operating phase the increase in the size of the loops is counteracted by the retrograde waves, which transfer the increase in size so that it takes place towards the inlet and the increase does not reach the outlet. This occurs at the end of a certain time, such as about 10 minutes. A complete reverse wave then takes place, which passes through the entire container, reaching the inlet loop, which suddenly increases in size. This results, via suitable pick-up means, such as a sensor 12 visible on FIGS. 2 and 4 in the change-over from normal operations to the adjustment phase. The independent inlet motor means come to a stop or definitely slow down, whereas the outlet motor means of extraction and shafts remain unaffected.

Consequently, the inlet loop, the tail of which is stopped or considerably decelerated, rapidly resumes its original size, resulting in a return to the initial condition of normal operation, which thus recommences.

While during the operation there is always a continuous longitudinal helix present within the container, it is formed of continuously entering, and egressing different new loops curved at about right angles to their advancing direction. The helix as such is continuously subjected to the three-dimensional forces of the apparatus, which alternately propagates it and stops it, causing it to contract and expand and simultaneously to shrink, to swell and to oscillate continuously with undulating ridges assymetrically but harmoniously running back and forth, the stops concentrating the propagating energy intermittently at the points selected by the present improvements, providing together with the changing speeds disturbances in the sizes and speeds of the loops.

FIG. 1 shows a number of elements of the apparatus for the conveying of coiled strip, similar to those disclosed in the parent case. An insertion device 3 for the material and motors 70 for serving to drive it, bending roller 4, rotary carrier shafts 5 and 6 connected by a coupling device 73 to a motor 72 which also drives extraction devices 74 for the materials are provided. An additional improvement is that the processing container is a tank 1 having the cross section of a reversed point arch with an angle at the apex which is approximately equal to a right angle. The lateral walls or flanks of the tank are substantially circular cylinders. The capstan 21 and the motor 70 of FIG. 1 of the parent application are eliminated.

In FIG. 1 of the present case the inlet motor 70 drives the elements feeding the strip and the outlet motor 72 drives the shafts and means of extraction. Operation and stop of motor 70 are controlled by a sensing element 12 shown on FIG. 2; motor 72 drives the elements of extraction at a speed slightly lower than that at which motor 70 drives the elements of introduction of the strip.

Figure 2:
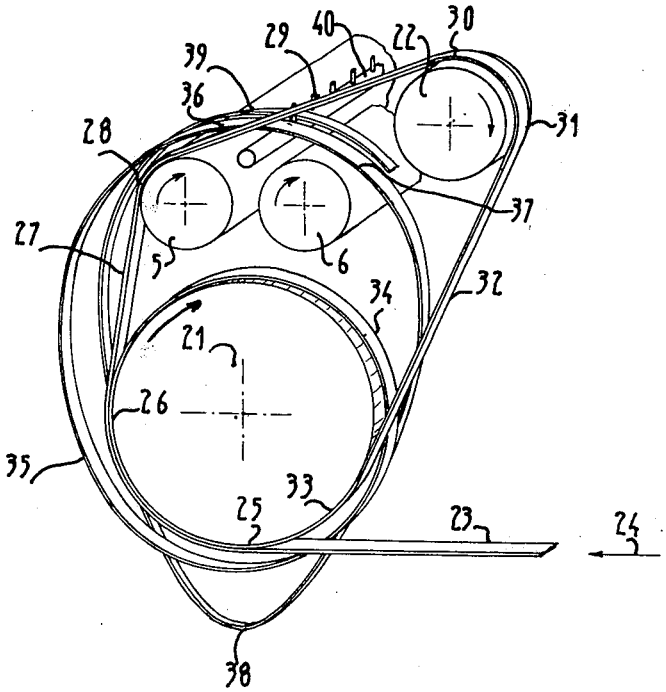
FIG. 2 is a schematic sectional diagram of a processing container, with associated motor means for causing strip material to enter it and to move through the container.

As may be seen from FIG. 2, this tank is lined internally with anti-corrosive bricks 2 which are indispensable when the treatment bath is acid; the level of the bath is shown at N.

PVC, polyvinyl chloride, forms the coating of the rotating shafts because of its low coefficient of friction. The loops are advanced by the shafts by sliding and slipping over them. The covering of the side walls of the container must have a very high friction coefficient in order to ascertain a temporary stop of the loops which come in contact with it. The coating used in the parent application was lava. Lava presents the problem of being a natural rock, the physical properties of which as well as its friction coefficient are not constant. Lava therefore is not a viable material.

Furthermore, lava wears out rather fast, resulting in two different difficulties which can be overcome with electroceramic tiles. First, due to its wearing out, lava produces powder which mixes with the treatment-fluid resulting in thick mud threatening to clog the inlet and outlet ducts of said fluid. Second lava slabs cannot be incorporated in the anti-corrosive brick lining of the walls because their frequent replacement due to wearing out would imply a complete rearrangement of the whole covering.

Ceramic tile on the other hand is an industrial product which gives us a choice of certain physical properties, especially the friction coefficient, which properties can be maintained at a constant level. This then would be a viable material. Ceramic tiles being almost everlasting, are preferably incorporated in the rest of the covering.

Therefore, one of the lateral walls or flanks 15 of the tank on the same side as the bending roller 4, is partially lined, approximately half-way up the wall, with slabs 16 of such ceramic tiles or equivalent material integrally with the anti-corrosive bricks.

The motor means shown in FIG. 2, are those for the introduction of the material 100 which in this case is strip metal. Roller trains 3*a* and 3*b* drive the band practically without slip, followed by a bending roller 4 serving to give it a suitable curvature. These rollers have a cylindrical surface, and the strip is not cambered transversally. It therefore retains its intrinsic elasticity. The strip then passes over the "upstream" and "downstream" rotary carrier shafts 5 and 6, forming the first loop 9, of which the normal shape is almost circular, since the peripheral speed of the shafts is greater than the insertion speed produced by 3*a* and 3*b*. A permanent slip of the band thus takes place on the shafts. The other loops, such as 10, are normally larger than the first, with more or less elongated shapes, and descend more or less towards the bass of the tank.

As the driving speed of the shafts exceeds the insertion speed of the material, the loops tend to increase in size on the outlet side of the tank, so that one loop 11 makes contact with the slab 16, which has a friction coefficient greater than that of the lining of the shafts. It has been found by experience that each loop is attracted towards the immersed part of the downstream flank in the tank, in front of which the material to be treated moves past from the top downwards. The result is that with tanks, having a vertical sectional plane of symmetry identical with the vertical plane of symmetry of the pair of rotary shafts, the transient contacts begin to form on this part of the downstream flank of the tank. Now this circumstance makes it easier to keep the loop in the vertical position, because a contact of this kind, which is lateral, tends to cause the loop to raise only above the upstream rotary shaft but by no means above the downstream rotary shaft. On the contrary, if the transient contact were effected at the lowest point of the base of the tank, at a distance equal from the two rotary shafts, the turn would tend to rise simultaneously above these two shafts and come to rest on the side, at the risk of penetrating the plane of an adjacent turn.

The contact of loops 11 and 16 only lasts a moment, and this loop then moves away again, driven by the loop immediately downstream from it. In its departure it has resumed a normal size. The surplus length which it has lost, because one of its ends slipped on the shaft, is carried over to the loop immediately upstream from it, which likewise comes to a stop or continues to move, according to whether this surplus causes or does not cause it to touch the lining 16 and so forth. This is the basic regulating phenomenon, and the conjunction of these phenomena produces a regulating cycle, which will now be described by reference to FIGS. *5a* to *5d*.

These figures show a schematic plan view of the tank 1, the insertion motor means 3 with their independent motor 70, the rotary carrier shafts 5 and 6 driven by the motor 72, and the extraction motor means 74 driven by the same motor 72 as the shafts. FIGS. *5a* and *5d* depict the same commencement and termination of the complete regulating cycle.

In FIG. *5a* all the turns are substantially of the same size. In *5b* the effect of the surplus speed of the shafts manifests itself in a non-uniform size for the turns, and one turn $S_1$ contacts the flank of the tank 1; the transient contact in question is transmitted to $S_2$, then still farther "upstream", resulting in a "retrograde" wave which reaches $S_n$ without rising any higher. At this moment (FIG. *5b'*) all the turns between $S_1$ and $S_n$ have been regulated. The retrograde wave is merely temporary, because the excess length of $S_1$ in *5b* has been shared between $S_1$ and $S_n$. Only a very short time elapses between *5b* and *5b'* (a few seconds).

At a later period (FIG. *5c*) another turn $S_3$, by transient contact with the tank, sets up a further temporary retrograde wave between points from $S_3$ to $S_p$ (FIG. *5c'*). A number of retrograde waves may occur at the same time, and the effect of these waves, proceeding upstream, in conjunction with the general progression downstream, resulting from the excess speed of the shafts, produces a perpetual vibration in the coil, contrasting with the deceptive regularity of the helical configuration of material of the prior art systems, in which rigidity of the turns results from the camber of the strip.

If steps would be provided for keeping this length constant i.e. by striclty equalising the inlet and outlet speeds, this length could be kept constant throughout an entire working operation, such as a day. In practice this is not possible, because the driving means at the inlet and at the outlet are imperfect. The material being treated undergoes a more or less uncertain slip, which is also assymmetrical, because the surface of the strip at the outlet is different in nature from its surface at the inlet, owing to the very treatment which it has undergone.

An operator therefore has to keep a watch on the coil and use his judgement in controlling the entry speed, in order to ensure that on the average it would be equal to the outlet speed. This step is a considerable improvement over the prior art, as the operator no longer has to handle the treated material directly and he is able to keep watch simultaneously on a number of production lines side by side.

The invention provides a method for regulating the length of the coil, which is entirely automatic, this result being obtained by the alternation of normal running conditions with an adjustment phase.

During normal operation the entry speed by rollers 3, exceeds the outlet speed by rollers 74. The length of the strip being treated increases, and this increase $\Delta L$ is shown along the ordinates on the graph of FIG. 6, in which the time is shown on the abscissae. The average size of the loops increases, and the adjacent loops at the outlet begin to increase likewise; at the moment shown on FIG. *5d* a loop $S_4$ effects transient contact with the flank of the tank; this results in a complete retrograde wave which reaches the inlet and transfers to the first loop 9 the entire excess length $\Delta L$. The loop 9 suddenly increases in size at 9' as shown on FIGS. *5d'* and 2.

It acts on a sensor 12 which stops the insertion means for the time required to enable the excess length $\Delta L$ to be reabsorbed (FIG. *5d''*). This constitutes the adjustment phase. When the loop 9 has resumed its normal size the conditions shown in FIG. *5a* prevail once again and a repetition occurs with a fresh cycle commencing under normal running conditions.

If for some reason the motor means for the extraction of the material slow down or even come to a stop, the shafts will stop likewise and the contact 12 will shut off the means for the insertion of the material.

The premise for the aforesaid improvement is that the extraction speed must never exceed the entry speed.

In accordance with FIG. 1, the motor directly drives the extraction means 74, driving the shafts 5 and 6 via a coupling device 73 which is a speed changer.

It is essential that the drive of the rotary shafts should be effected simultaneously with that of the extraction means. It is also essential to make the speed ratio between these two driving operations adjustable, because, while on extraction, there is every reason to ensure that the drive of the material being treated is of the positive kind, without slip, this is by no means the case with the drive of this material by the rotary shafts; the processed material on the rotary shafts is subject to a certain slip, because the adhesion of the said material to the said shafts is comparatively weak, this adhesion being produced solely by the weight of the loop resting on the shafts, and it is because the magnitude of this slip depends on a number of different factors, which change according to the sample of the material being treated, that it is necessary to adjust the aforementioned speed ratio. If the drive of the processed material by the rotary shafts were likewise positive, the problem of regulating the coil would obviously not arise.

The coefficient of friction of the treated material on the lining material of the base or flanks of the tank must be greater than that of this material on the lining of the rotary shafts, as otherwise the contact of the said material on the base or flanks of the tank could not be temporary only and would manifest itself in a protracted friction on the lining material, since the adhesion to the rotary shafts would predominate. When a loop is simultaneously in contact with the rotary shafts, which do not cease rotating and with a certain stationary part of the base or flanks of the tank, the adhesion of the treated material to the lining material of the stationary part must be stronger than its adhesion to the lining of the rotary shafts. This is the reason why for this lining, polyvinyl chloride has been selected, because of its low coefficient of friction with most solids, so that the strips, wires or metal tubes adhere to it far less firmly than to the slabs of volcanic lava or electroceramic tiles, the latter having proved to be more efficient.

Therefore and in view of the slip of the processed material on the rotary shafts, it will become obvious that in order to compensate this slip, the rotary shafts must be caused to rotate at a relatively higher speed; otherwise the output of the insertion or entry means would not be transmitted in its entirety to the output of the extraction means, and the helical material would tend to undergo a continuous radial shrinkage from the point of insertion to the point of extraction. On the contrary, if the rotary shafts have a peripheral speed exceeding the compensation of the slip, the coil will tend to undergo a gradual radial increase from the point of introduction to the point of extraction; this circumstance starting from the last loop before the extraction, is in every way favorable to the production of the phenomenon of transient contacts, which propagates itself, within a few seconds, from the last loop as far as the first loop following the introduction.

Thus forward and backward directed wave patterns of the progressing expanding and contrary helix with undulating ridges and continuous oscillation thereof are produced of predetermined controllable amplitudes, durations and frequencies. Optimum treatment-fluid exposures to the coils are provided, as the progressing, vibrating elastic helix churns up the treatment-fluid, whereby simultaneously the sizes of the loops and their intermittent transient stopovers are controlled. Preferably during the first normal operating stage the steps are interposed of regulating the entry speed of the material into the container to exceed the exit speed by between about 0.2 and about 2% and of controlling the ratio of the decreasing speed of the second stage relative to the increasing speed of the first stage to the order of a few hundred.

Figure 3:
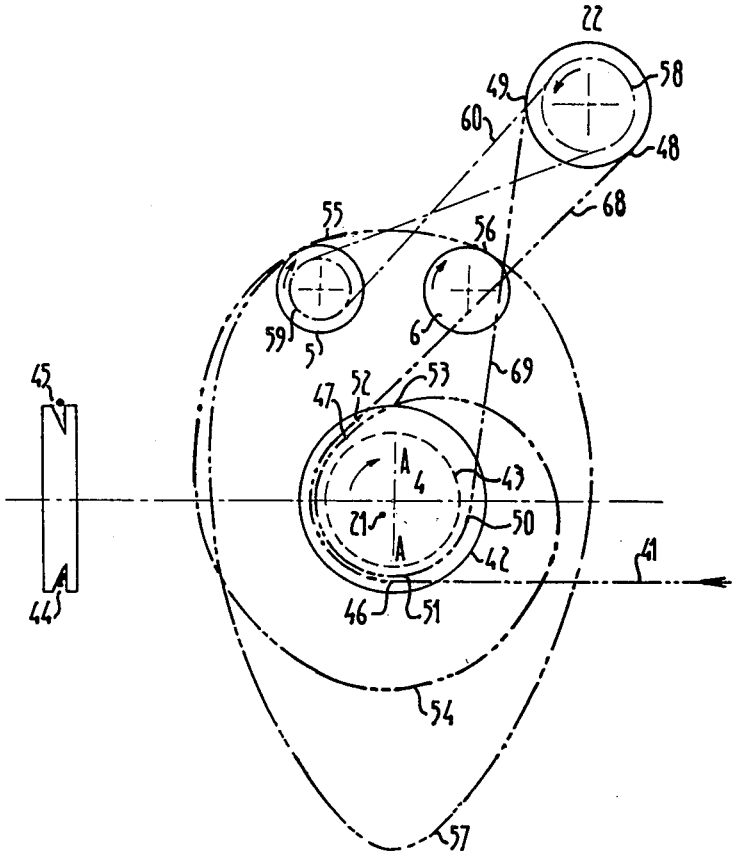
FIGS. 3 and 4 correspond to FIGS. 1 and 2 and depict the operation with the material to be treated being a wire.
Figure 4:
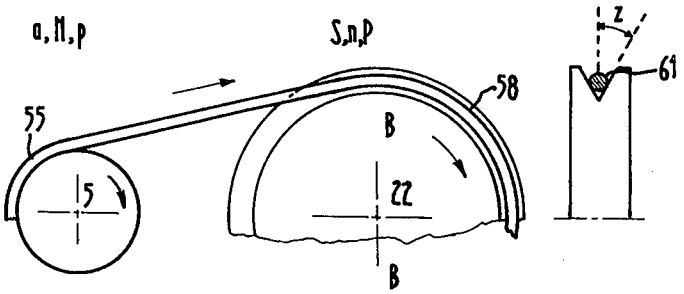
Figure 5:
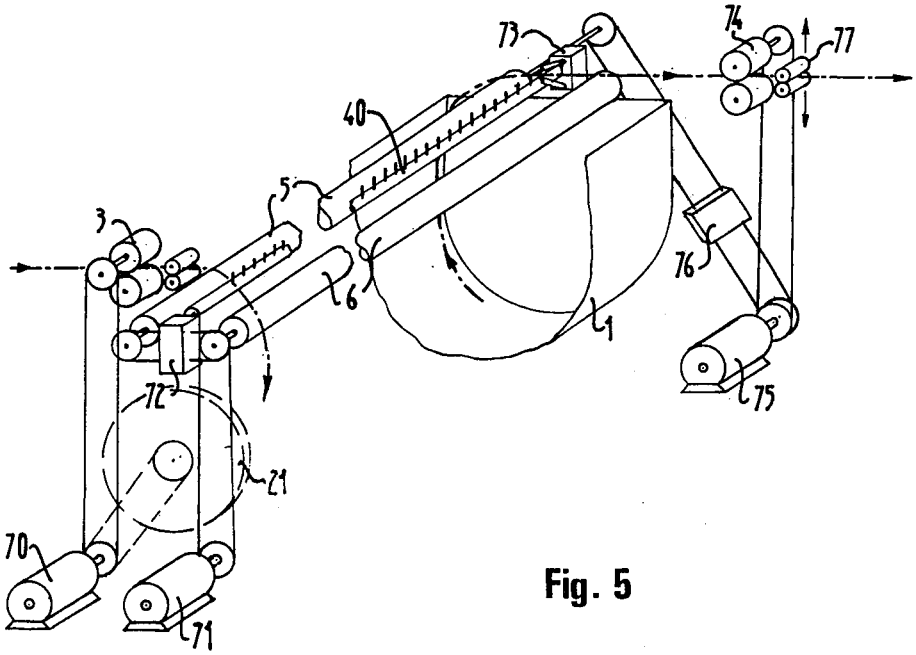
FIGS. 5, 5*a*, 5*b*, 5*b'*, 5*c*, 5*c'*, 5*d*, 5*d'* and 5*d''* are schematic diagrams of a cycle for the regulation of the loops of the coil.
Figures 5, 5A, 5B, 5C, 5D, 6:
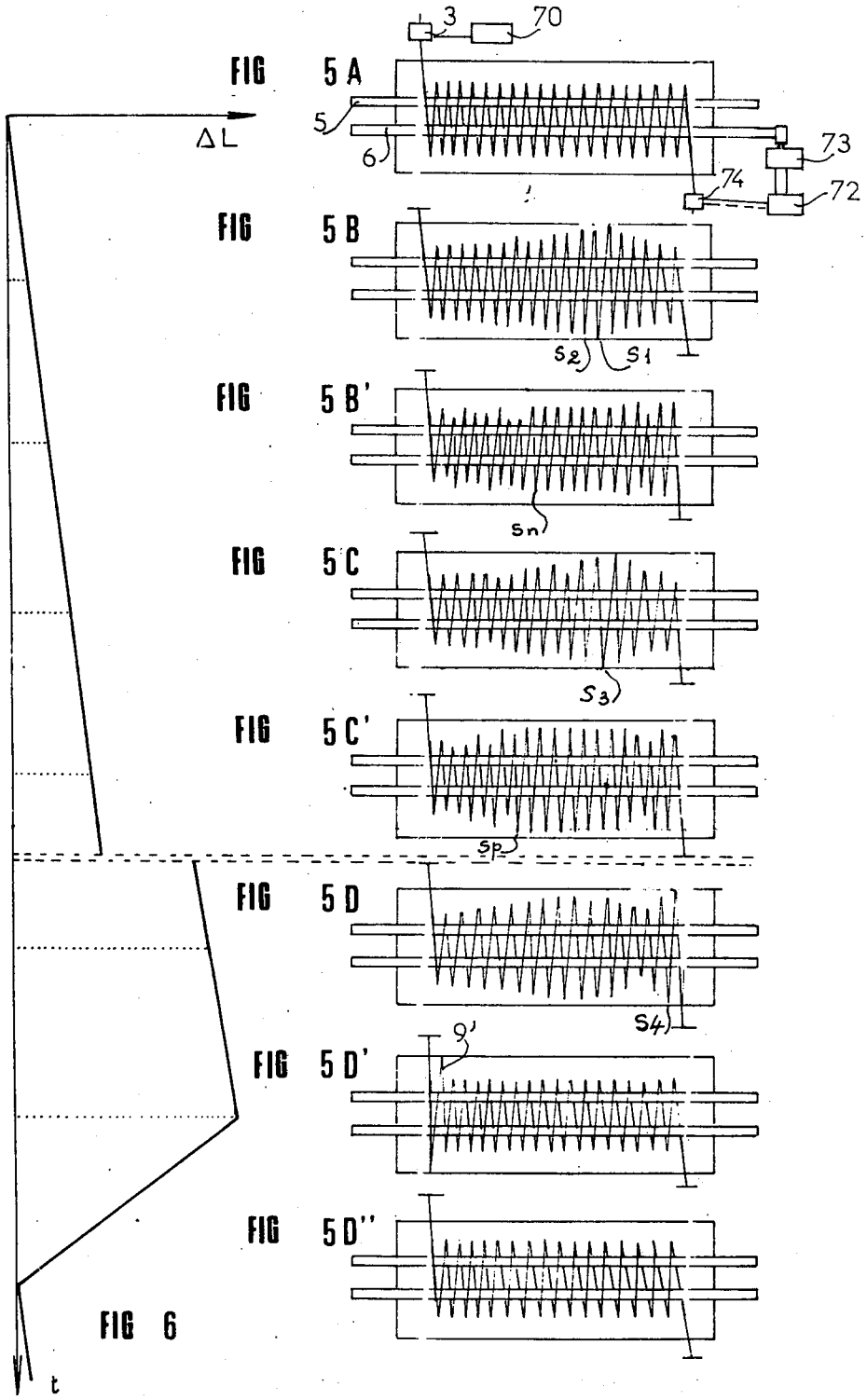
FIG. 6 represents graphical coordinations of the variation in the period of time and length of the material in the processing container shown in FIGS. 5*a* to 5*d''*.

FIGS. 3 and 4 are analogous to FIGS. 1 and 2, except that the profile of the tank 1 is adapted to the treatment of wire instead of strip. Wire being more rigid than strip, the configuration of the turns is closer to the circular: this is why the angle at the apex will preferably be about 120° instead of a right angle. The processing container is thus utilized more satisfactorily, and there is nevertheless no risk of the turns touching the bottom of the tank. The means for the introduction and extraction of the wire are naturally adapted to the profile of the material; they consist of rollers with circular grooves. As regards the rest of the system, the apparatus and operation are the same as in the case of strip metal; a normal operating phase, characterized by three decreasing successive linear speeds, i.e. carrier shafts, material entering and material emerging, and a phase during which the length of the material in the container is adjusted, for which phase the speed of the material at the inlet is nullified or at all events greatly reduced by comparison with the outlet speed.

In any case, during the normal running phase, the ratio between the insertion speed and the extraction speed of the material must be greater than 1, if the apparatus is to function satisfactorily. Experience has shown, however, that this ratio must be very close to 1 and that the inlet speed must not exceed the extraction speed by more than 1%. A preferred satisfactory speed ratio is about 604/600, in which case the insertion speed is about 0.7% about the extraction speed. On the other hand, the peripheral speed of the rotary shafts supporting the material must be about 1 to 2% greater than the extraction speed.

Finally, the foregoing numerical data show that for a normal operating phase of 5 to 10 minutes the adjustment phase, during which no material is entering the apparatus, amounts to about 2 to 4 seconds.

The method steps of the invention are diagrammatically represented on FIG. 7.

Figure 7A:
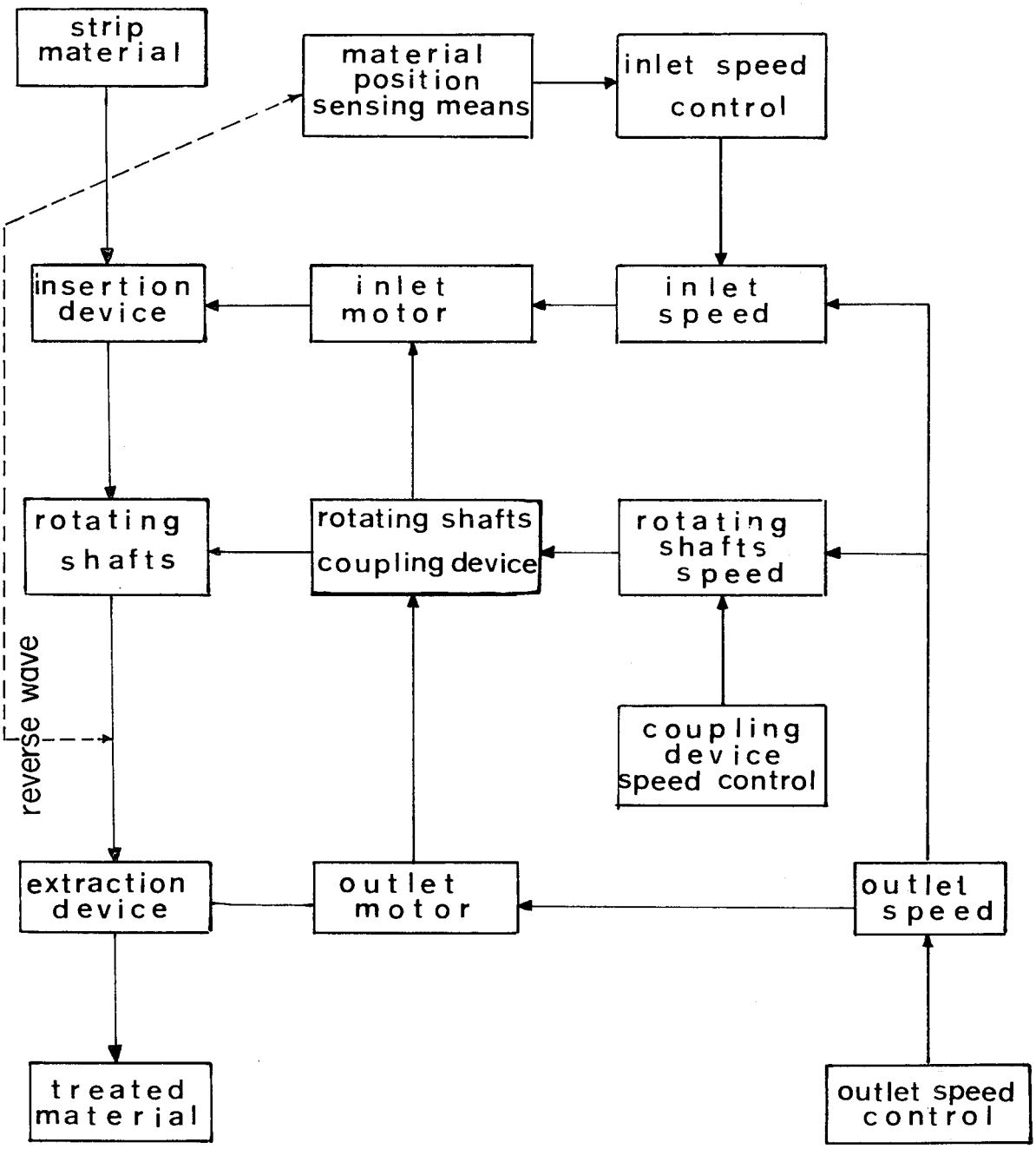
FIG. 7*a* is a schematic bock diagram showing the correlations and controls of the several steps and speeds according to the invention.
Figure 8:
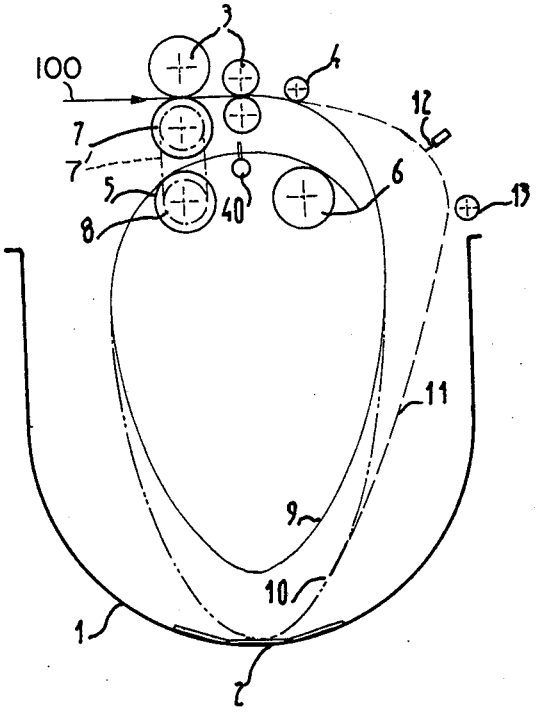
FIGS. 8 to 12 are identical with FIGS. 1 to 5 of the parent case, Ser. No. 361,616.
Figure 9:
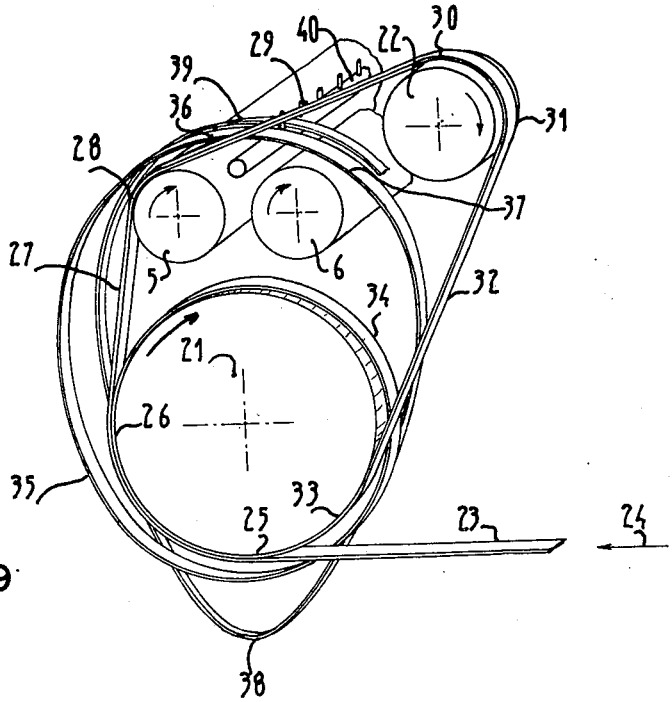
Figure 10:
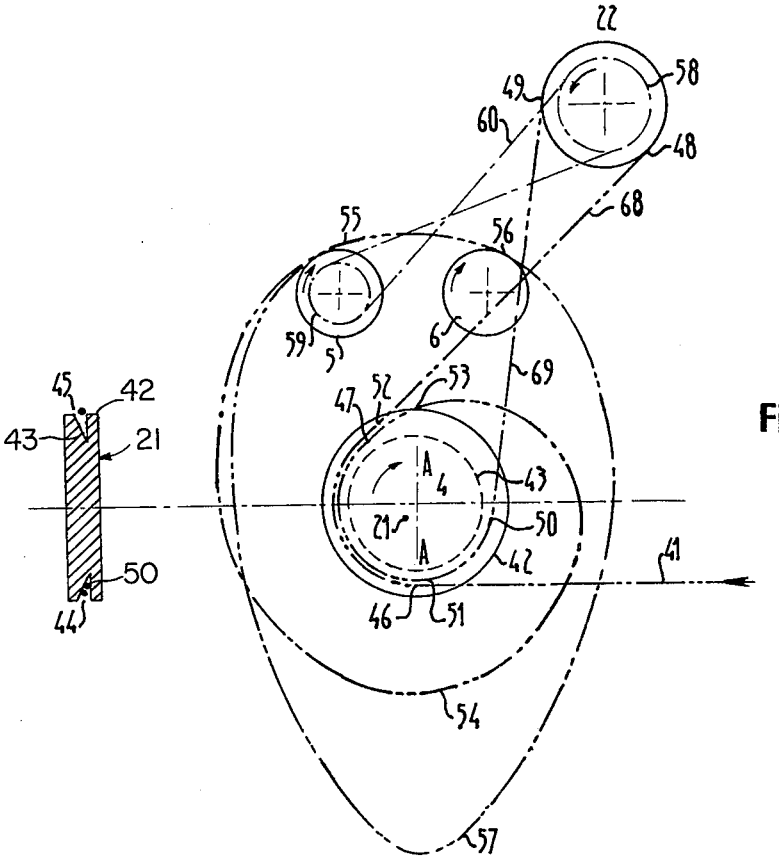
Figure 11:
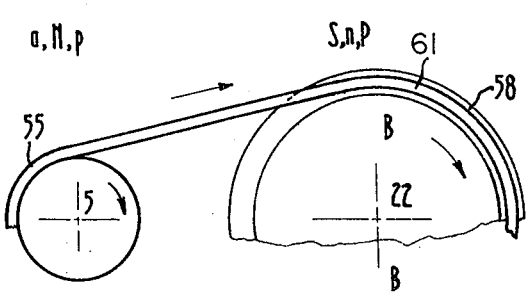
Figure 11A:
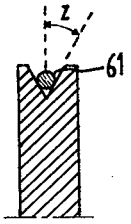
Figure 12:
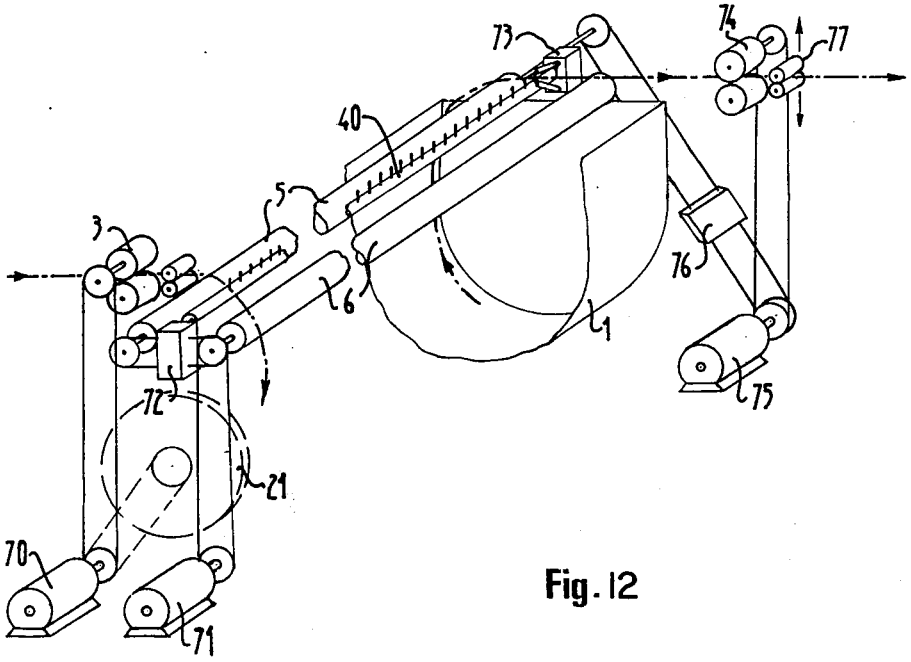

The correlations and controls of the several steps means and speeds according the invention are represented on FIG. 7*a*.

A predetermined oulet speed, controlled by an outlet speed control, results in a predetermined speed of the outlet motor. A coupling device speed control controls the speed of the device coupling the rotating shafts to the outlet motor, resulting in a predetermined rotating shafts speed and material advance speed. Material position sensing means monitor the material introduced through the insertion device and control the inlet speed through an inlet speed control, resulting in an inlet motor speed for the inlet motor, which itself commands the insertion device.

I claim:

1. A method for treatment of elongated flexible materials consisting of metallic strips, bands, tubes and wires in an elongated container prefilled with a treatment fluid comprising the steps of:

A. Coiling the elongated material into loops
B. Imparting to the material the shape of a helix
C. Introducing the helix into a container having a cross-sectional shape of an arch at an initial inlet speed under a positive impelling force
D. Causing at least a partial immersion of the loops of the helix in treatment acid in the container
E. Advancing the helix through the container at a predetermined advance speed
F. Correlating the inlet speed with the advance speed of the material at a predetermined ratio
G. Causing intermediate momentary intermittent interruptions in the advancement of loops resulting in controllable forward and backward wave patterns of the advancing helix of predetermined durations and amplitudes, frequencies and directions of the loops.
H. Correlating the advance speed with the exit speed at a predetermined ratio.

2. A method as claimed in claim 1, further comprising the steps of:

I. Extracting the loops of the helix from the container at a predetermined exit speed.

3. A method for treatment of elongated flexible materials consisting of metallic strips, bands, tubes and in an elongated container with a treatment-acid comprising:

A first normal operating stage of providing steps for:
imparting the material a coiled configuration of loops;
causing the loops to assume the shape of an elongated continuous helix;
causing the helix to advance through the treatment-acid at a predetermined level thereof with momentary intermittent stops;
regulating the linear advance speed of the material to equal about an average predetermined speed, the length of the material in the container thus increasing during said first stage;
A second adjustment stage providing the step the of decreasing the ingress speed of the material.

4. A method as claimed in claim 3, the said advance speed initially being about equal to the said egress speed.

5. A method as claimed in claim 3, further comprising the step of regulating the entry speed of the material into the container to exceed its exit speed by between about 0.2% and about 2% during the first normal operating stage.

6. A method as claimed in claim 3, further comprising the step of controlling the ratio of the decreasing speed of the said second stage relative to the increasing speed of the first stage to the order a few hundred.

7. A method as claimed in claim 3, further comprising the step of sensing the presence of the material in a predetermined position within the container.

8. A method as claimed in claim 3, further comprising the step of regulating the respective speeds at an adjustable speed ratio.

* * * * *

UNITED STATES PATENT OFFICE

CERTIFICATE OF CORRECTION

Patent No. 4,026,724 Dated May 31, 1977

Inventor(s) Marcel A. P. Giros

It is certified that error appears in the above-identified patent and that said Letters Patent are hereby corrected as shown below:

On the title page the following should be added:

--[30] Foreign Priority Data

May 24, 1972 France .....72.19235 --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*